US006884109B1

(12) United States Patent
Ray

(10) Patent No.: US 6,884,109 B1
(45) Date of Patent: Apr. 26, 2005

(54) ELECTRICAL CORD ROLL-UP APPARATUS

(76) Inventor: Jeffrey A Ray, 101 S. Harding Ave., Johnstown, CO (US) 80534

( * ) Notice: Subject to any disclaimer, the term of this patent is extended or adjusted under 35 U.S.C. 154(b) by 0 days.

(21) Appl. No.: 10/705,003

(22) Filed: Nov. 10, 2003

(51) Int. Cl.[7] ..... H01R 13/72
(52) U.S. Cl. ..... 439/501
(58) Field of Search ..... 439/4, 501; 191/12.4

(56) References Cited

U.S. PATENT DOCUMENTS 3,585,324 A * 6/1971 Renndorfer et al. ..... 200/52 R
3,733,478 A * 5/1973 Barker ..... 362/387
3,929,210 A 12/1975 Cutler et al.
3,964,490 A 6/1976 Nelms
4,284,180 A * 8/1981 Masters ..... 191/12.2 R
4,300,665 A 11/1981 Arechaga
4,897,512 A 1/1990 Johnston
5,518,417 A * 5/1996 Liu ..... 439/501
5,700,150 A 12/1997 Morin
5,701,981 A 12/1997 Marshall et al.
6,199,674 B1 * 3/2001 Liao ..... 191/12.4
6,273,225 B1 8/2001 Park
6,331,121 B1 12/2001 Raeford, Sr.
6,349,808 B1 2/2002 Bryant

* cited by examiner

*Primary Examiner*—J. F. Duverne
*Assistant Examiner*—Phuong Dinh
(74) *Attorney, Agent, or Firm*—Ancel W. Lewis, Jr.

(57) ABSTRACT

An electrical cord roll-up apparatus has a stationary assembly and a reel assembly that rotably mounts on the stationary assembly. The stationary assembly has a shaft, an insulator on the shaft, axially spaced rings on the insulator and a power input or output cord that connects to the rings. The reel assembly has a reel tube with side flanges on the ends and brush assemblies mounted on the tube in alignment with the rings. The brush assemblies have copper or brass brushes that are pressed against the rings by compression springs, and connectors for connecting to the wires of the electrical cord. Rotating the reel one direction winds the electrical cord onto the reel and rotating the reel in the opposite direction unwinds the electrical cord.

11 Claims, 2 Drawing Sheets

ELECTRICAL CORD ROLL-UP APPARATUS

TECHNICAL FIELD

The present invention relates to electrical cord storage and handling apparatus, and more particularly to an electrical cord roll-up apparatus with axially arranged rings and brushes.

BACKGROUND ART

A loose electrical cord lying on the floor or on the ground can be a safety hazard, and can be damaged by people walking on the cord or vehicles driving over the cord. Electrical cord roll-up apparatus provide an easy means for storage of electrical cords. Such roll-up apparatus typically have a stationary assembly and a reel assembly rotably mounted on the stationary assembly. The reel assembly can be manually actuated, spring actuated or motor driven.

A plug or socket may be mounted directly onto the stationary assembly or a short "pig tail" cord may be connected to the stationary assembly. The primary electrical cord is electrically connected to the reel assembly which is in turn electrically connected to the stationary assembly, so that the primary electrical cord can be wrapped around the reel assembly without electrical disconnection. A high quality, consistent, wear resistant connection between the stationary assembly and the reel assembly is desirable.

Prior known devices have used radially spaced side contacts on either the stationary assembly or the reel assembly with radially spaced, disk shaped rings on the other assembly to make the electrical connection between the assemblies. The outwardly spaced contacts on such devices will wear more quickly. Rigidly mounted contacts on these devices can provide inconsistent electrical contact if there is end float or bearing looseness between the stationary and reel assemblies. U.S. Pat. No. 4,897,512 to Johnston and U.S. Pat. No. 6,331,121 to Raeford, Sr. disclose roll-up apparatus with substantially rigidly mounted, radially spaced side contacts.

Some prior known devices with radially spaced side contacts use thin, flat, metal contacts. Generally this type of contact projects at an angle between the stationary and reel assemblies. The resilience of the metal provides some pressure of the contact against the rings and limited compensation for relative movement between the stationary and reel assemblies. U.S. Pat. No. 3,929,210 to Cutler et al., U.S. Pat. No. 3,964,490 to Nelms, U.S. Pat. No. 4,300,665 to Arechaga, U.S. Pat. No. 5,701,981 to Marshall et al., and U.S. Pat. No. 6,349,808 to Bryant each disclose an electrical cord roll-up apparatus with thin, flat, metal, radially spaced side contacts.

U.S. Pat. No. 5,700,150 to Morin discloses an electrical cord roll-up apparatus with two axially spaced, thin, flat, metal contacts that project outwardly at an angle from the stationary assembly to contact cylindrical rings on the reel assembly. U.S. Pat. No. 6,273,225 to Park discloses an electrical cord roll-up apparatus having a complex shaft with axial spaced, electrically insulated contact portions. Opposed pairs of thin metal contacts are axially spaced and mounted on the reel assembly, with each contact wrapping partially around a contact portion. The consistency and quality of the electrical contact in the above two devices is limited by the contact pressure which is limited to the resilience of the contact metal.

DISCLOSURE OF THE INVENTION

An electrical cord roll-up apparatus includes a shaft assembly and a reel assembly rotably mounted on the shaft assembly. The shaft assembly has a hollow shaft, an insulator extending along a section of the shaft, axially spaced conductive rings on the insulator and a pigtail cord. The pigtail cord extends into the shaft and has a pigtail wire for each ring. The pigtail wires extend through the shaft and insulator, and one wire connects to each ring. The reel assembly has a reel tube with spaced side flanges at opposite ends, and a brush assembly mounted on the tube for each ring. The reel tube fits over the insulator and the brush assemblies are aligned with the rings and electrically separated or insulated from each other. Each brush assembly has an inwardly opening brush holder, a brush in the brush holder that electrically contacts a ring, and a compression spring that biases or presses the brush against the ring. The brushes are brass or copper. The brush assemblies include connectors that crimp onto the electrical cord and the electrical cord is rolled onto the reel assembly when the reel tube is rotated in one direction and unrolled when rotated in the opposite direction.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
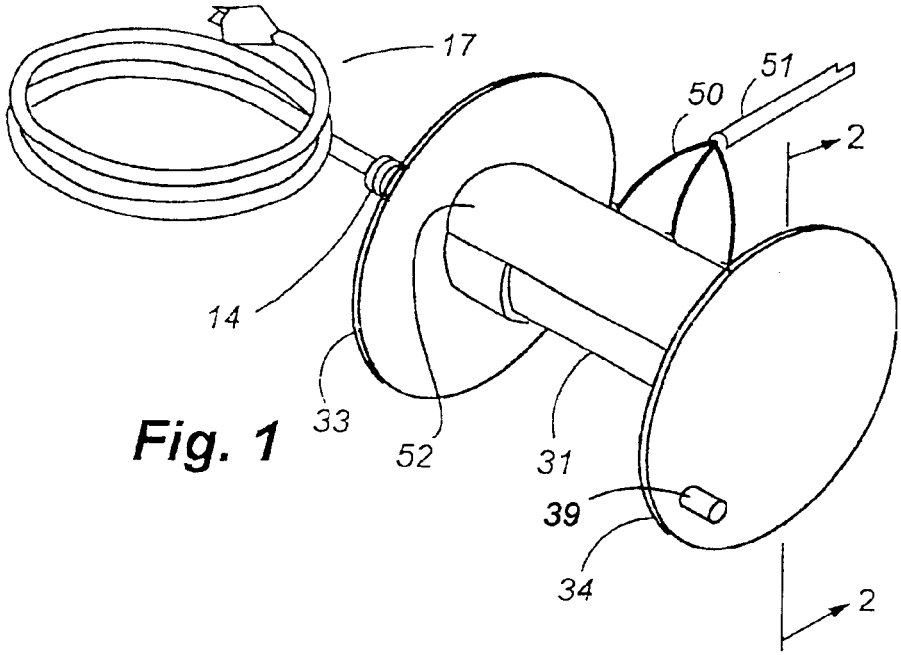
FIG. 1 is a perspective view of an electrical cord roll-up apparatus embodying features of the present invention.
Figure 2:
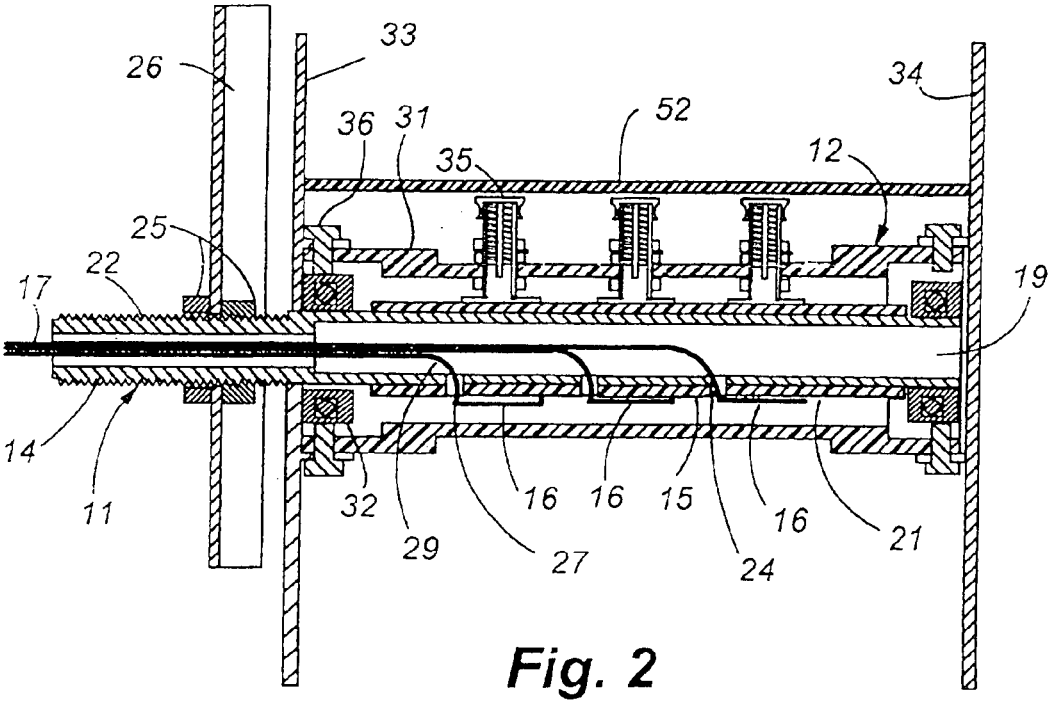
FIG. 2 is a sectional view of taken along line 2—2 of FIG. 1.
Figure 3:
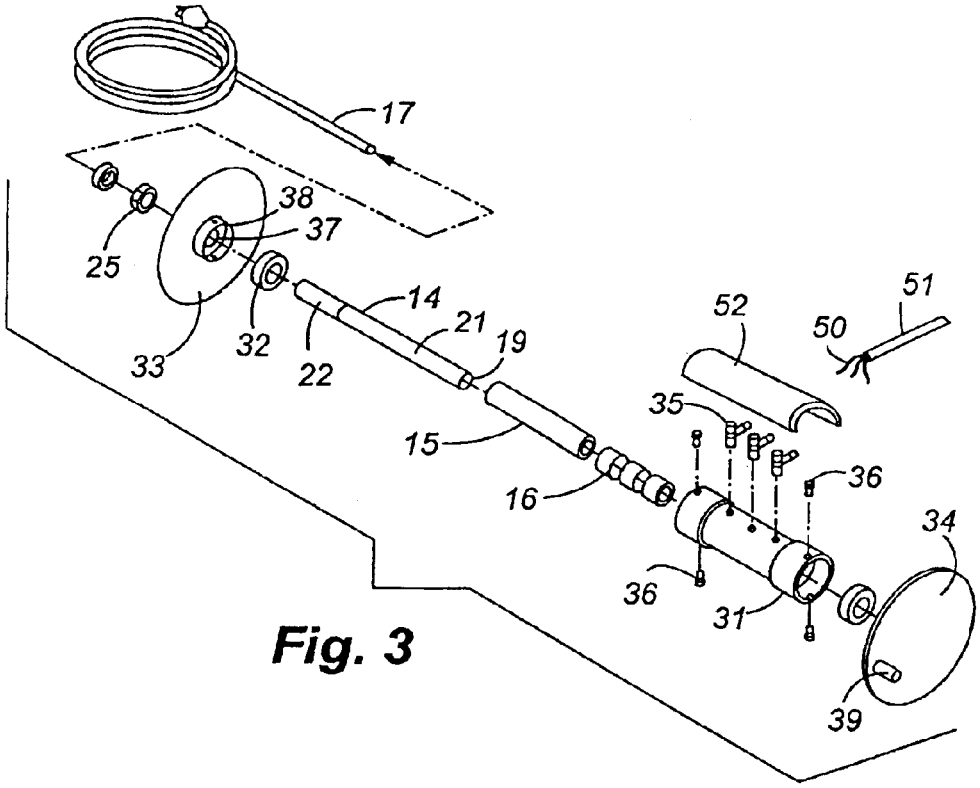
FIG. 3 is an exploded view of the roll-up apparatus of FIG. 1.

Referring to FIGS. 1, 2 and 3, an electrical cord roll-up apparatus embodying features of the present invention includes a stationary assembly 11 and a reel assembly 12. The stationary assembly 11 has an elongated shaft 14, an insulator 15, a plurality of conductive rings 16 and a pigtail cord 17. The shaft 14 is hollow, forming an interior cavity 19. The shaft 14 shown includes an elongated cylindrical section 21 and a threaded section 22 that extends axially from one end of the cylindrical section 21. Axially spaced shaft wire apertures 24, with one shaft wire aperture 24 for each ring 16, extend through the cylindrical section 21 into the interior cavity 19. A pair of jam nuts 25 that thread onto the threaded section 22 are provided for mounting the stationary assembly 11 onto an upright support 26 such as an angle iron.

The insulator 15 has a hollow, elongated cylindrical shape, and is sized and shaped to fit snugly over the cylindrical section 21 of the shaft 14 with the cylindrical section 21 of the shaft 14 extending axially beyond both ends of the insulator 15. The insulator 15 includes insulator wire apertures 27 that extend through the insulator 15 in alignment with the shaft wire apertures 24. The rings 16 are made of an electrically conductive material such as copper or brass and each have a hollow cylindrical shape. The rings 16 are mounted in an axially spaced relationship on the insulator 15 adjacent to the insulator wire apertures 27. Generally, three rings are provided, for grounded 120 volt three wire electrical cords. Other numbers of rings 16 may be used, such as four for four wire, three phase circuits.

The pigtail cord 17 shown extends into the interior cavity 19 of the shaft 14 from the open end of the threaded section 22 and includes a pigtail wire 29 for each ring 16. The pigtail wires 29 pass through the shaft wire aperture 24 and the insulator wire apertures 27, and are electrically connected to the rings 16. The pigtail cord 17 may end at an end of the shaft 14 or may extend any selected distance beyond shaft 14, and may be connected to a plug or socket, depending on the application.

The reel assembly 12 includes a reel tube 31, two bearings 32, first and second flanges 33 and 34, and a plurality of brush assemblies 35, with one brush assembly 35 for each ring 16 on the stationary assembly 11. The reel tube 31 has a hollow cylindrical shape with an inner diameter slightly larger than the outer diameter of the rings 16 so that the reel tube 31 fits over the rings 16 in a spaced relationship. The reel tube 31 is about as long as the cylindrical section 21 of the shaft 14 and extends beyond both ends of the insulator 15 when fitted over the rings 16. In the illustrated embodiment the reel tube 31 is made from a non-conductive or insulator material.

The bearings 32 fit into opposite ends of the reel tube 31 and rotably mount the reel assembly 12 on the stationary assembly 11. In the illustrated embodiment, the bearings 32 are pressed onto the cylindrical section 21 of the shaft 14 at opposite ends of the insulator 15. The first and second flanges 33 and 34 each have a generally flat, circular disk shape. The first flange 33 a center aperture 37 and a transversely extending circular wall 38 around the center aperture 37. The second flange 34 also includes a centered transversely extending circular wall 38. The circular walls 38 are sized to fit over the ends of the reel tube 31. The first and second flanges 33 and 34 are secured to opposite ends of the reel tube 31 and the reel tube 31 is secured to the bearings 32 by cap screws 36 through the circular walls 38 and through opposite ends of the reel tube 31, with the threaded section 22 of the shaft 14 extending through the center aperture 37 of the first flange 33. An axially outwardly projecting handle 39 is attached to the second flange 34 to facilitate manual winding of the reel assembly 12.

Figure 4:
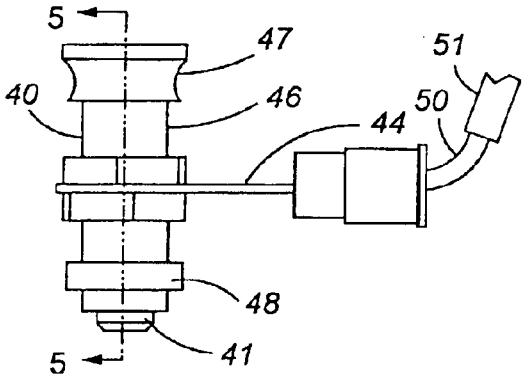
FIG. 4 is a side elevation view of a brush assembly of the roll-up apparatus of FIG. 1.
Figure 5:
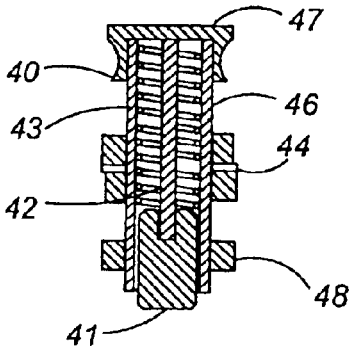
FIG. 5 is a sectional view of taken along line 5—5 of FIG. 4.

As shown in FIGS. 4 and 5, each brush assembly 35 includes a tubular brush holder 40, a brush 41, a compression spring 42, a brush wire 43 and a connector 44. In the illustrated embodiment the brush holder 40 has a hollow cylindrical, conductive, externally threaded brush tube 46, an internally threaded, conductive tube cap 47 and three hex nuts 48. Each brush tube 46 mounts in and extends through the reel tube 31 in alignment with and spaced outward from one of the rings 16. The hex nuts 48 are sized to thread onto the brush tube 46, and two hex nuts 48 secure the brush tube 46 to the reel tube 31 with one hex nut 48 inside and one hex nut 48 outside the reel tube 41. The connector 44 shown is a ring type crimp connector that fits over the brush tube 46, outwards from the reel tube 31, and is secured by the third hex nut 48. The tube cap 47 threads onto the outer end of the brush tube 46 to close the outer end of the brush tube 46.

The brush 41 slidably fits into the brush tube 47 and projects beyond the open end of the brush tube 46 to contact the ring 16. The compression spring 42 fits into the brush tube 46 between the tube cap 47 and the brush 41, to press or bias the brush 41 against the ring 16. The brush wire 43 is connected to the tube cap 47 and the brush 41, to electrically connect the brush 41 and the brush holder 40. The brush wire 43 is preferably made of flexible conductive material such as very small copper wires woven or braided together. The brush wire 43 provided has a selected length greater than the distance from the tube cap 46 to the brush 41, to accommodate wear in the brush 41 and looseness in the bearings 32, and to assure consistent pressure of the brush 41 against the ring 16. The brush 41 is preferably made of brass to minimize wear.

Referring again to FIGS. 1, 2 and 3, the wires 50 of an electrical cord 51 connect the connectors 44. A semi-cylindrical cover 52 fits over the brush assemblies 35, extending from the first flange 33 to the second flange 34. Rotating the reel assembly 12 in one direction winds the electrical cord 51 about the reel tube 31 and rotating the reel assembly 12 in the opposite direction unwinds the electrical cord 51. The axial arrangement of the rings 16 and brush assemblies 35 of the electrical cord roll-up apparatus of the present invention provides more reliable and consistent electrical contact. The brush assemblies 35 of the present invention, with the compression spring biased brushes 41 have more consistent pressure and thereby more consistent electrical contact. The copper brushes 41 of the present invention provide excellent electrical contact with improved wear.

Although the present invention has been described with a certain degree of particularity, it is understood that the present disclosure has been made by way of example and that changes in details of structure may be made without departing from the spirit thereof.

What is claimed is:

1. Apparatus for rolling up an electrical cord having a plurality of electrical wires comprising:

an elongated, hollow shaft, a plurality of axially spaced, electrically insulated, conductive rings mounted on said shaft, a hollow reel tube rotably mounted on said shaft spaced around said rings, and a plurality of axially spaced, electrically insulated brush assemblies mounted on said reel tube and each connected to one of said electrical wires, each said brush assembly being aligned with one said ring, and having a brush and a compression spring that presses said brush against said ring.

2. Apparatus as set forth in claim 1 wherein said brushes are made of brass.

3. Apparatus as set forth in claim 1 wherein each said brush assembly includes an inwardly open brush holder mounted through said reel tube with said spring fitting into said brush holder and said brush slidably fitting into said brush holder inwards of said spring.

4. Apparatus as set forth in claim 3 wherein said reel tube is made of a non-conductive material to provide electrical insulation of said brush assemblies.

5. Apparatus as set forth in claim 4 wherein said brush holders are made of a conductive material and said brush assemblies each include a brush wire that electrically connects said brush to said brush holder.

6. Apparatus as set forth in claim 5 wherein said brush holders each have a hollow cylindrical, conductive, externally threaded brush tube, an internally threaded, conductive tube cap that threads onto and closes an outer end of said brush tube, and first and second hex nuts that thread onto said brush tube inside and outside of said reel tube, respectively, to mount said brush tube on said reel tube.

7. Apparatus as set forth in claim 6 wherein each said brush holder includes a third hex nut that threads onto said brush tube outwards from said second nut, and a ring type crimp connector that fits onto said brush tube and is secured between said second and third hex nuts, said connector being crimpable onto a said electrical wire.

8. Apparatus as set forth in claim 1 including a cylindrical insulator mounted between said shaft and said rings to electrically insulate said rings.

9. Apparatus as set forth in claim 8:

wherein said shaft and insulator include shaft wire apertures and insulator wire apertures, respectively, adjacent to said rings, and including a pigtail cord that extends into said shaft and has a plurality of pigtail wires that each pass through a said shaft wire aperture and a said insulator wire aperture and connect to a said ring.

10. Apparatus as set forth in claim 1 wherein said shaft includes a cylindrical section for rotably mounting said reel tube, an externally threaded section, connected to an end of said cylindrical section, and a pair of jam nuts that thread onto said threaded section for stationary mounting of said shaft, whereby said threaded section is adapted to be supported by a support to support said shaft during rotation of said reel tube.

11. Apparatus for rolling up an electrical cord having a plurality of electrical wires comprising:

an elongated, hollow shaft including a cylindrical section, an externally threaded section, connected to an end of said cylindrical section, and a pair of jam nuts that thread onto said threaded section for stationary mounting of said shaft, said cylindrical section having a plurality of axially spaced shaft wire apertures, a cylindrical insulator mounted over said cylindrical section and having a plurality of axially spaced insulator wire apertures aligned with said shaft wire apertures, a plurality of axially spaced, cylindrical, conductive rings mounted on said insulator adjacent to said insulator wire apertures, a pigtail cord that extends into said shaft and has a plurality of pigtail wires that each pass through a said shaft wire aperture and a said insulator wire aperture and connect to a said ring, a non-conductive, hollow, cylindrical reel tube rotably mounted on said cylindrical section of said shaft and spaced over said rings, and a plurality of axially spaced brush assemblies mounted on said reel tube, each aligned with one said ring, each said brush assembly including an inwardly opening brush holder, a compression spring sized to fit into said brush holder, a brass brush sized to slidably fit into said brush holder and to be biased by said spring against said ring, and a brush wire connected to said brush, each said brush holder having a hollow cylindrical, conductive, externally threaded brush tube, an internally threaded, a conductive tube cap that threads onto and closes an outer end of said brush tube and connects to said brush wire, first and second hex nuts that thread onto said brush tube inside and outside of said reel tube, respectively, to mount said brush tube on said reel tube, a ring type crimp connector that fits onto said brush tube against said second hex nut, and a third hex nut that threads onto said brush tube and secures said connector against said second hex nut, said connector being crimpable onto a said electrical wire.

* * * * *